US006580399B1

(12) United States Patent
Ballinger et al.

(10) Patent No.: US 6,580,399 B1
(45) Date of Patent: Jun. 17, 2003

(54) ANTENNA SYSTEM HAVING POSITIONING MECHANISM FOR REFLECTOR

(75) Inventors: Bruce D. Ballinger, Rancho Palos Verdes, CA (US); Jeffrey P. Michaels, Redondo Beach, CA (US); Steven W. Lee, Redondo Beach, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/044,272

(22) Filed: Jan. 11, 2002

(51) Int. Cl.[7] ..... H01Q 13/00; H01Q 3/02

(52) U.S. Cl. ..... 343/781 P; 343/757; 343/765; 343/882; 343/DIG. 2

(58) Field of Search ..... 343/781 P, 781 CA, 343/878, 879, 880, 881, 882, 757, 765, DIG. 2

(56) References Cited

U.S. PATENT DOCUMENTS 4,562,441 A * 12/1985 Beretta et al. ..... 343/781 P
6,124,835 A * 9/2000 Nguyen et al. ..... 343/881
6,366,255 B1 * 4/2002 Chiang ..... 343/781 P
6,492,955 B1 * 12/2002 Amyotte et al. ..... 343/781 P
6,504,514 B1 * 1/2003 Toland et al. ..... 343/781 P

* cited by examiner

*Primary Examiner*—Hoang Nguyen
(74) *Attorney, Agent, or Firm*—Antonelli, Terry, Stout & Kraus, LLP

(57) ABSTRACT

An antenna system is provided for a satellite. This may include a main reflector (100), a subreflector (110), a boom including a first boom component (88) to support said main reflector and a second boom component (86) to support the subreflector. The first boom component may include a first main support (130), a fitting (150), and a second main support (140). The fitting may couple the first main support and the second main support. A positioning mechanism (120) may be provided within the fitting to support the main reflector. The positioning mechanism may be capable of adjusting a position of the main reflector.

30 Claims, 6 Drawing Sheets

ANTENNA SYSTEM HAVING POSITIONING MECHANISM FOR REFLECTOR

BACKGROUND OF THE INVENTION

1. Field of the Invention

The present invention relates to antennas for satellites. More particularly, the present invention relates to an antenna system that includes a positioning mechanism for a reflector.

2. Discussion of Related Art

Communications satellites in a geosynchronous orbit may utilize antennas for uplink and downlink communications with the Earth. A satellite uplink communications signal is transmitted to a satellite from one or more ground stations located on the Earth; and a satellite downlink communications signal is transmitted from a satellite to one or more ground stations located on the Earth. The uplink and downlink signals are received and transmitted respectively at particular frequency bands that are typically in the ratio of about 3:2 (uplink frequency band: downlink frequency band) for Ka band. The signals may also be coded.

A satellite is equipped with antennas or antenna systems to receive and transmit the uplink and downlink signals, respectively. To minimize the number of satellites in a constellation and maximize communications capabilities, it is desirable for each satellite to have the capability to communicate with locations on the Earth within the satellite's field of view.

BRIEF SUMMARY OF THE INVENTION

Embodiments of the present invention may provide an antenna system for a satellite. The antenna system may include a main reflector, a subreflector, an antenna boom, and a positioning mechanism. The antenna boom may include a first boom component to support the main reflector and a second antenna boom component to support the subreflector. The first boom component may include a first main support, a fitting and a second main support. The fitting may couple the first main support to the second main support. The positioning mechanism may be provided within the fitting (e.g. within an inner area) to support the main reflector. The positioning mechanism may be capable of adjusting a position of the main reflector.

The positioning mechanism may be a wobble plate, a compact small angle positioner (CSAP), a biaxial gimbal, for example. Other types of positioning mechanisms are also possible.

The first main support and the second main support may each be a tubular graphite support. The fitting may be a metal fitting, such as an aluminum or titanium fitting, or may be a graphite fitting. The fitting may be bonded and/or bolted to the first graphite support and may be bonded and/or bolted to the second graphite support. The positioning mechanism may also be bonded/bolted to the fitting.

Embodiments of the present invention may also include an antenna system that includes an antenna boom having a first boom part, a second boom part, a third boom part, and a mechanism to support and adjust a position of a reflector such as the main reflector. The mechanism may be coupled to a location within an inner area of the second boom part.

Other embodiments, objects, advantages and salient features of the invention will become apparent from the detailed description taken in conjunction with the annexed drawings, which disclose arrangements and preferred embodiments of the invention.

BRIEF DESCRIPTION OF THE DRAWINGS

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and the invention is not limited thereto.

The following represents brief descriptions of the drawings in which like reference numerals represent like elements and wherein.

DETAILED DESCRIPTION OF PREFERRED EMBODIMENTS

Figure 1:
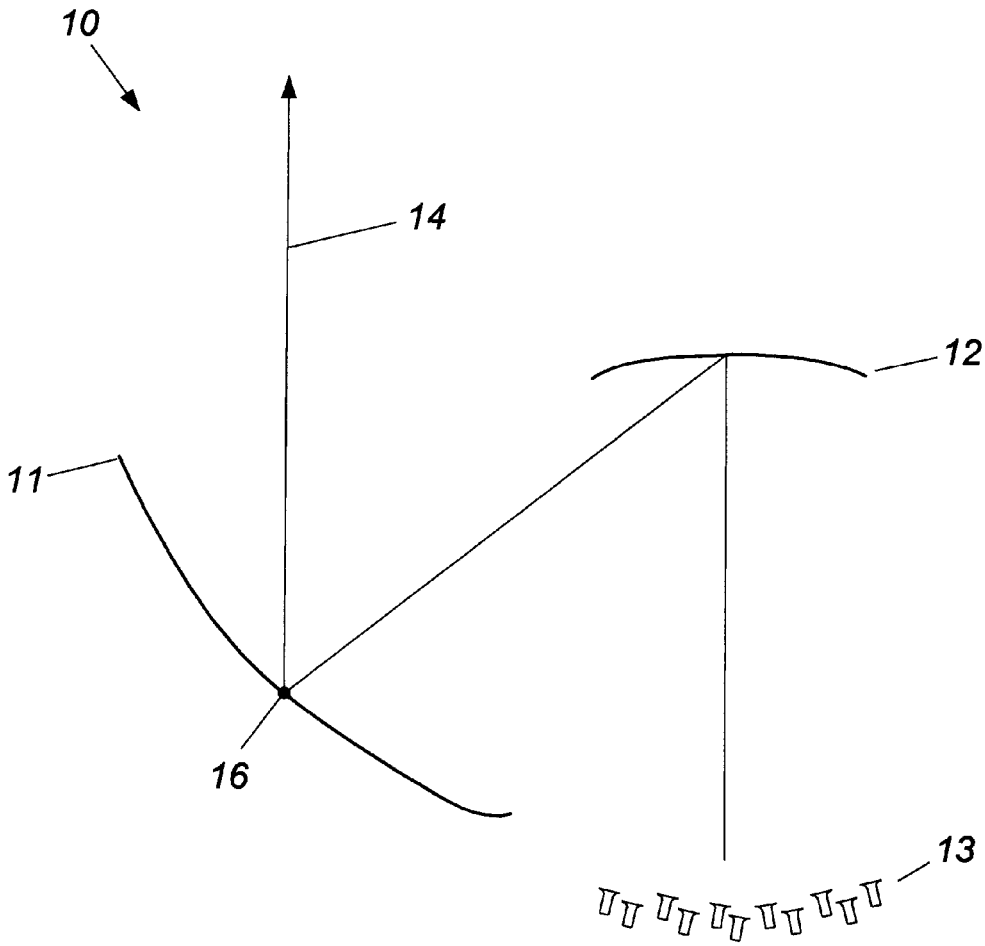
FIG. 1 is an offset gregorian antenna system.

In the following detailed description, like reference numerals and characters may be used to designate identical, corresponding, or similar components in differing drawing figures. Furthermore, in the detailed description to follow, examples may be given, although the present invention is not limited thereto.

FIG. 1 shows a plan view of an antenna 10 used for high gain communications from satellites. The antenna 10 is described in "A Dual Offset Reflector Multiboom Antenna for International Communications Satellite Applications", by Jorgensen Rolf et al., IEEE Transactions on Antennas and Propagation, Vol. AP-33, No. 12, Dec. 1985, the subject matter of which is incorporated herein by reference. The antenna 10 is an offset gregorian antenna having a main reflector 11, a subreflector 12 and a feed array 13. The feed array 13 may include multiple feed horns with each feed horn generating an illumination beam 14 that is reflected from the subreflector 12, the main reflector 11 and is directed toward a defined coverage area on the Earth.

The antenna 10 may provide a single beam from each feed horn in the feed array 13. To provide high gain beams, the main reflector 11 must be efficiently illuminated. To do so requires large feed horns, with the location of each feed horn determining the location of a corresponding beam on the Earth. To provide beams that are adjacently located and completely cover the Earth's field-of-view may require that all the feeds in the feed horn array 13 be physically positioned close together. If the feeds are not physically close together, the corresponding antenna beams may not be adjacently located and may be spaced too far apart on the Earth, with locations between antenna beams having no coverage. Large feed horns may be physically spaced close enough together within the antenna 10 to produce adjacent beams on the Earth. The antenna 10 may address this problem by using feed horns that are physically small so that the feed horns can be physically spaced close together. These smaller feed horns can produce adjacent beams but may not efficiently illuminate the reflectors 12, 11 resulting in high spillover losses and lower gain booms.

Figure 2:
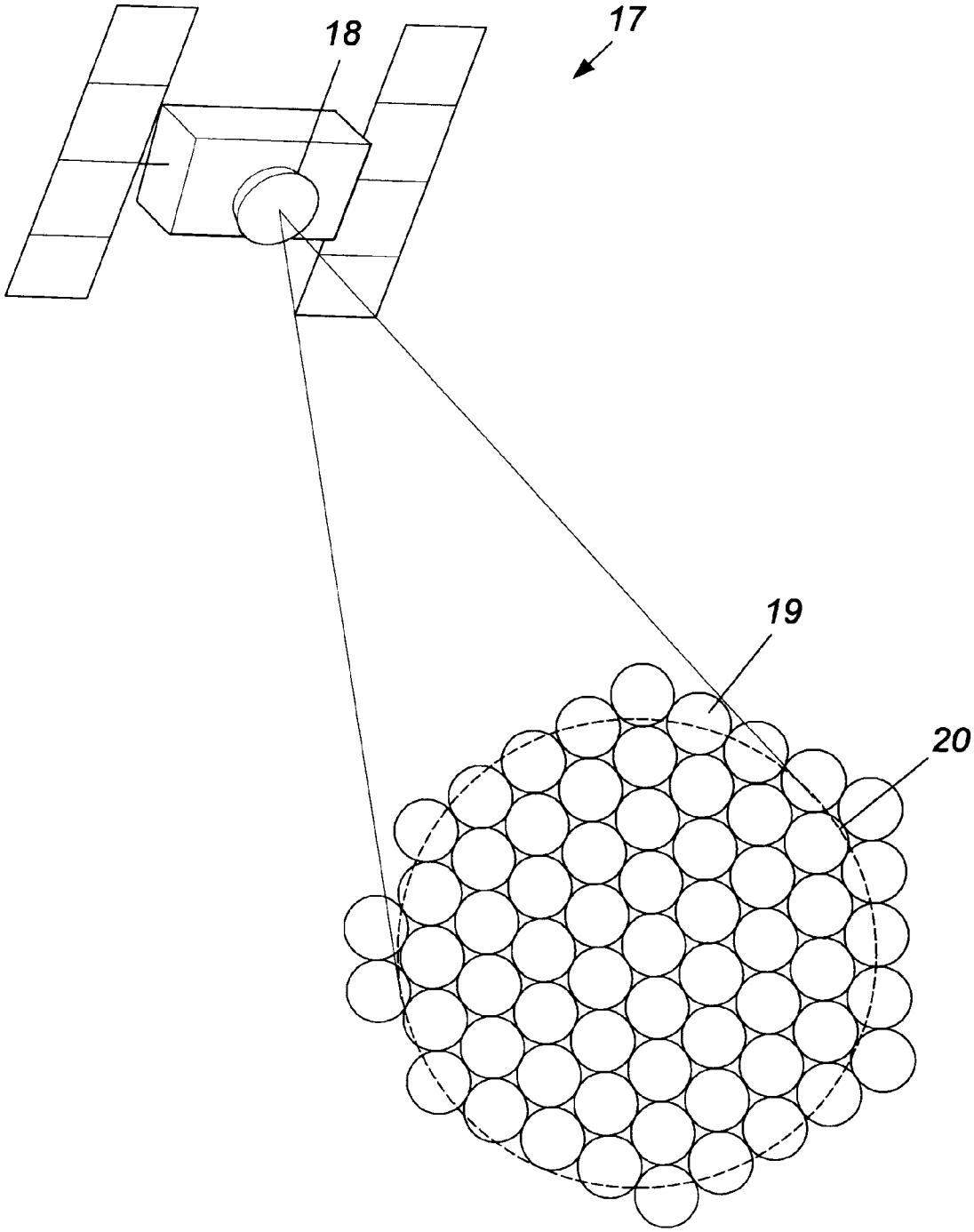
FIG. 2 is a drawing showing a satellite having an offset gregorian antenna system.

FIG. 2 shows a spacecraft 17 (such as a satellite) having an antenna system 18 for providing adjacent high gain antenna beams 19 on Earth 20. The antenna system 18 may be used for communications between the spacecraft 17 and the Earth 20 when the spacecraft 17 is preferably located in a geosynchronous or near geosynchronous orbit. The antenna system 18 may provide symmetrically shaped adjacent antenna beams 19 on the Earth 20 from the spacecraft 17.

Figure 3:
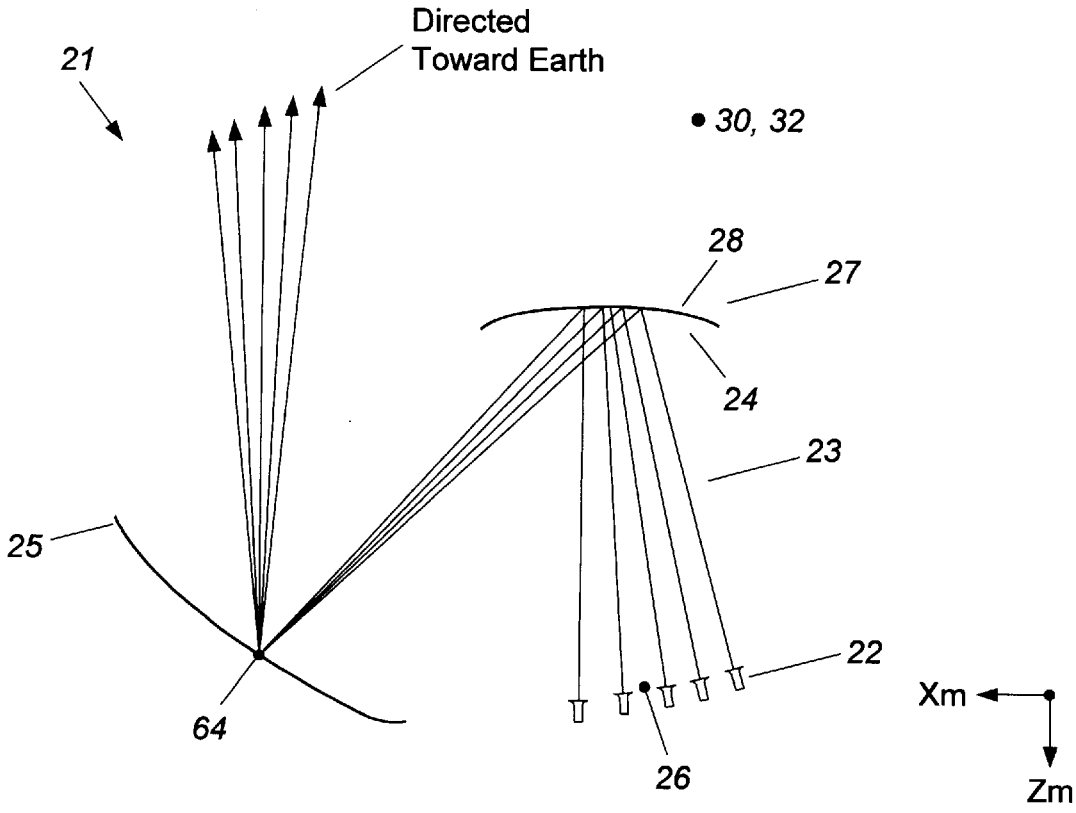
FIG. 3 is a side plane view of an offset gregorian antenna system.

FIG. 3 shows an antenna system 21 that includes a main reflector 25, a subreflector 27 and a feed array 22 configured in an offset gregorian antenna configuration so that the illumination beams (depicted by the lines marked 23) provided by the feed array 22 are reflected towards Earth from the main reflector 25 in a compact manner that is substantially or totally free of blockage by the subreflector 27 or the feed array 22. Each subreflector and main reflector combination and associated feed array together define a separate offset gregorian cassegrain antenna configuration. A more detailed discussion of offset gregorian antenna configurations can be found in "Development of dual reflector multiboom spacecraft antenna system" by Jorgenson et al. IEEE Transactions of Antennas and Propagation, Vol. AP-32, pp. 30–35, 1984, the subject matter of which is incorporated herein by reference. The location of the feed array 22 offset from the subreflector 27 and the main reflector 25 define the antenna system 21 as being "offset". The subreflector 27 may be a portion of a hyperbola that has a concave side 24 With an associated focal point 26 and a convex side 28 with an associated focal point 30. The main reflector 25 may be a portion of a parabola having a main reflector focal point 32. The subreflector 27 and the main reflector 25 may be positioned so that the focal point 32 of the main reflector 25 is approximately coincident with the focal point 30 associated with the convex side 28 of the subreflector 27. The feed array 22 may be placed in the proximity of the first focal point 26 associated with the concave side 24 of the subreflector 27 with the exact location of each feed in the array 22 being determined. The antenna system 21 may be configured so that the illumination beams 23 are incident on the concave side 24 of the subreflector 27, redirected towards the main reflector 25, and directed towards the Earth free of blockage by the subreflector 27 or the feed array 22.

Each feed in the feed array 22 may be positioned so that the central ray of each illumination beam 23 is incident on a separate preselected location on the subreflector 27. The central ray of each illumination beam 23 may be directed towards a preselected location on the subreflector 27. Thus, the subreflector 27 may be oversized and approximately 50–150 wavelengths at the frequency of operation of the antenna system to accommodate the desired location of each illumination beam 23 on the subreflector 27. The subreflector 27 may be configured to direct each illumination beam 23 towards the main reflector 25 so that the central ray of each illumination beam 23 is incident on the center 64 of the main reflector 25. As a result, a circular symmetrical illumination on the main reflector 25 may be obtained and nearly circular symmetric antenna beams 19 (FIG. 2) can be achieved, even when the antenna beam is scanned.

The position, orientation and pointing direction of each feed in the feed array 22 relative to the subreflector 27 and the main reflector 25 may determine the location of each antenna beam 19 (FIG. 2) on the Earth 20.

Serious consideration may be given to the design of an antenna system apart from the actual geometry of the antenna system for providing the desired Earth coverage area(s). Particularly, the feed array and reflectors may need to be mounted on a supporting structure in a manner that minimizes use of the available real estate on the satellite. Further, the antenna system must be compact and lightweight, but strong enough to survive the satellite launch. Typically, these designs may require that the reflectors be at least partially stowed in a folded position during launch, and later deployed once the satellite is in orbit. Deployment strategies may either deploy each reflector of a dual reflector antenna system on a separate boom or arm, or deploy one of the reflectors on a moveable arm and maintain the other reflector fixed to a bus or antenna structure. These designs may take up significant space to satisfy launch and deployment requirements. U.S. Pat. No. 6,124,835, the subject matter of which is incorporated herein by reference, discloses stowing and deployment of an antenna system according to one arrangement. Other arrangements are also possible.

Satellite antenna system may have a need for a lower profile storage approach for the antenna reflector system. In one approach, a reflector dish may be reoriented upon user commands. Upon satellite launch, a lower profile storage approach may provide a smaller, lighter, and less expensive cross-sectional surface that may decrease satellite cost.

Figure 4:
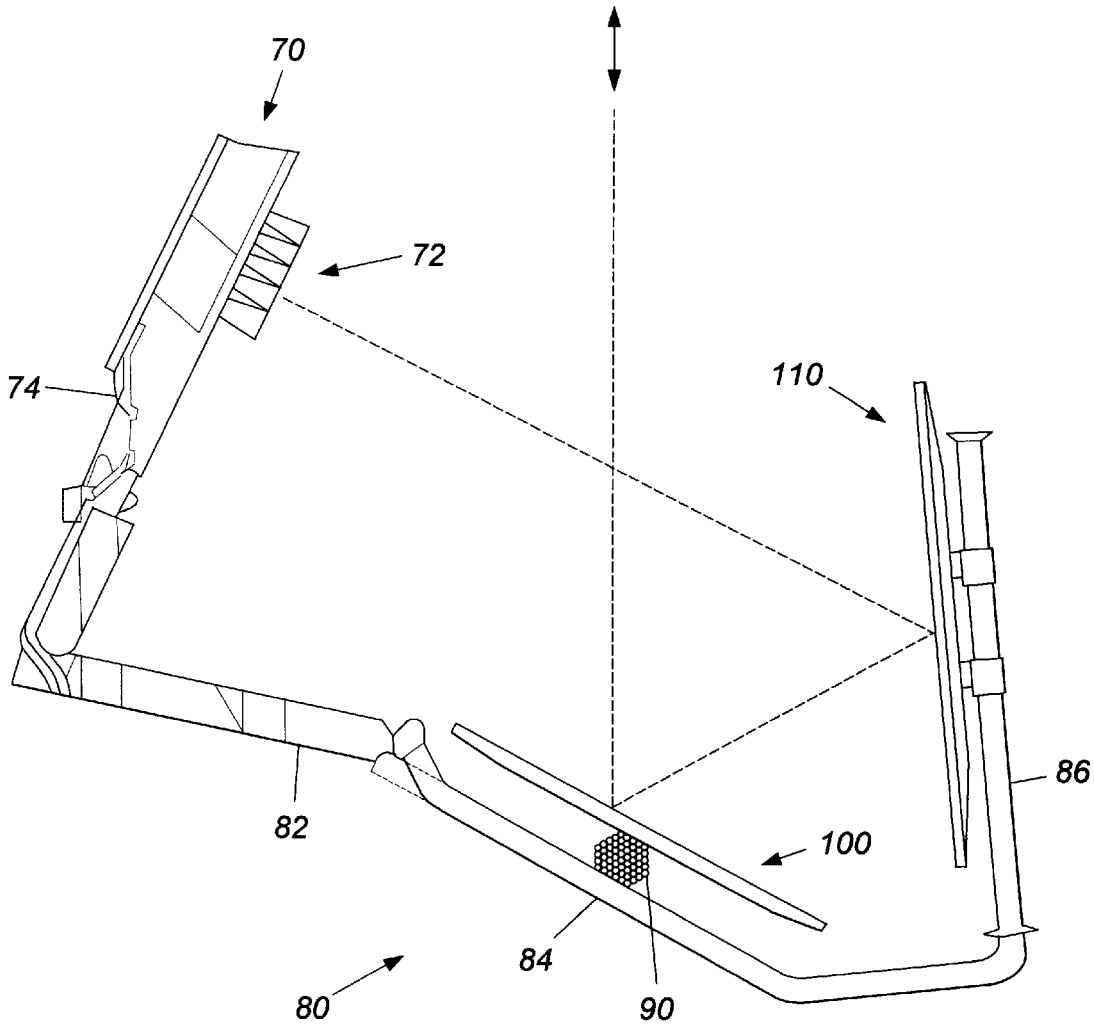
FIG. 4 is a view of an offset gregorian antenna system.

One method to tilt the reflector antenna is to mount a mechanical positioner directly to the antenna boom as will be described below with respect to FIG. 4. FIG. 4 is a view of an offset gregorian antenna system according to one arrangement. Other arrangements are also possible. FIG. 4 shows a feed panel 70 that contains a plurality of antenna feeds 72 to direct antenna beams as described above. The feed panel 70 may be supported by an arm 74 or a similar type of arm mechanism. FIG. 4 also shows an antenna boom 80 that includes a first antenna boom section 82, a second antenna boom section 84 and a third antenna boom section 86. Each of the antenna boom sections 82, 84 and 86 may be graphite (or similar type of material) as is well known in the art. The antenna boom 80 may contain appropriate mechanisms to allow the antenna boom section to fold up in a compact manner (such as during launch) and to enable alignment and reconfiguration when in orbit.

A main reflector 100 may be mounted above the second antenna boom section 84. A subreflector 110 may be mounted above the third antenna boom section 86. As discussed above, antenna beams may radiate from the feed 72 towards the subreflector 110, redirected to the main reflector 100 and then directed to Earth. However, it may be desirable to reposition the main reflector 100 once in orbit or every so often to correct misalignment problems. Accordingly, the second antenna boom section 84 may include a positioning mechanism 90 mounted on an outer surface of the tubular graphite piece forming the second antenna section 84. The main reflector 100 may be connected to the top of the positioning mechanism 90. The positioning mechanism 90 may reposition an angle of the main reflector 100 relative to the second antenna boom section 84 based on control signals.

One problem with the FIG. 4 arrangement is that the antenna mechanism increases the volume and weight because the reflector antenna attaches an extra distance from the boom. There is a need for a more lightweight, compact storage method that allows the antenna reflector to tilt.

Figure 5:
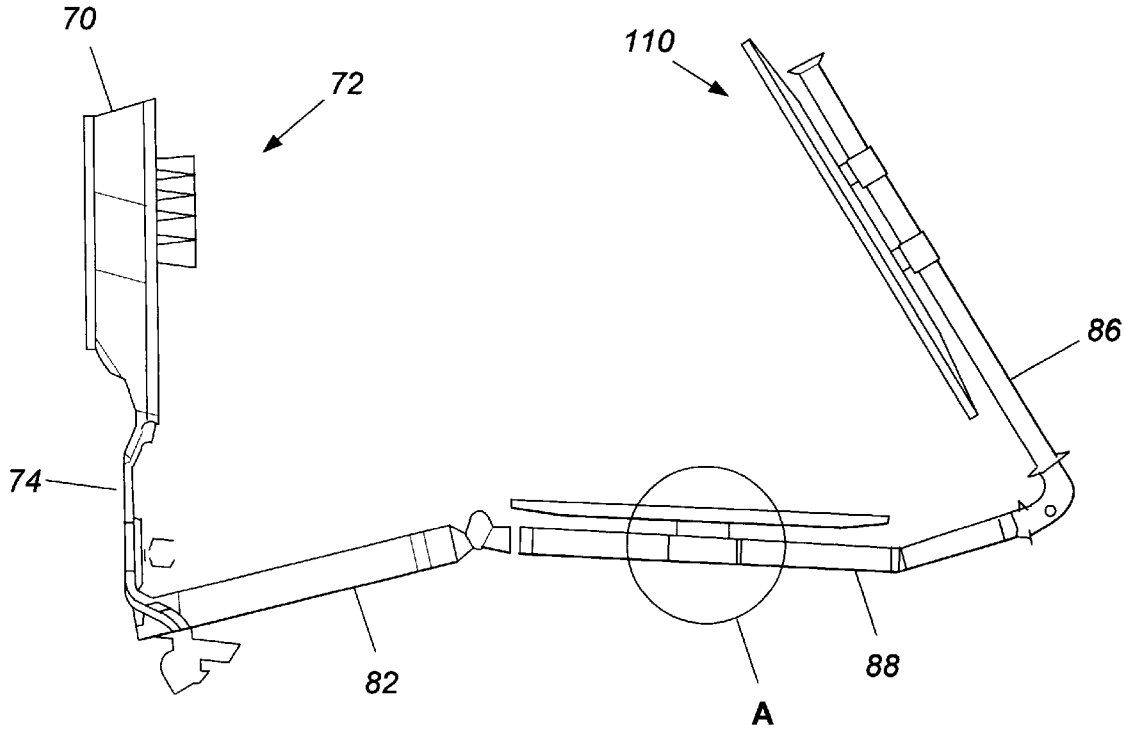
FIG. 5 is a view of an offset gregorian antenna system according to an example embodiment of the present invention.

FIG. 5 is a view of an offset gregorian antenna system according to an example embodiment of the present invention. Other embodiments and configurations are also within the scope of the present invention. More specifically, FIG. 5 includes a feed panel 70, feeds 72, and an arm 74 in a similar manner as FIG. 4. Additionally, the antenna boom section in FIG. 5 includes the first antenna boom section 82 and the third antenna boom section 86 in a similar manner as in FIG. 4. However, FIG. 5 includes a second antenna boom section 88 coupled between the first antenna boom section 82 and the third antenna boom section 86. The area circled A of the second antenna boom section 88 will now be described with respect to FIG. 6.

Figure 6:
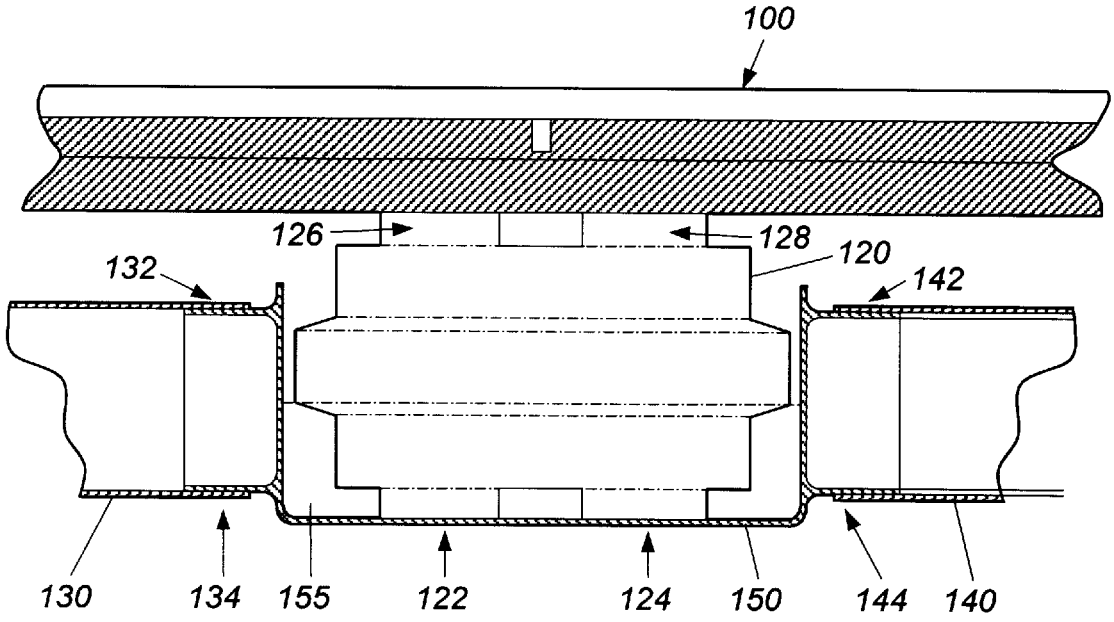
FIG. 6 is a view of the circled area A in FIG. 5.

FIG. 6 is a view of the circled area A in FIG. 5. That is, FIG. 6 shows a close-up view of the second antenna boom section 88. The second antenna boom section 88 may include a first section 130, a second section 140 and a fitting 150. The first section 130 may be coupled to the fitting 150, which in turn may be coupled to the second section 140. The first section 130 may be a tubular graphite piece and the second graphite section 140 may also be a tubular graphite piece. The fitting 150 may be a metal material, such as aluminum or titanium, or of graphite material, and is provided between ends of the first section 130 and the second section 140. That is, the fitting 150 may be coupled to the first section 130 at areas 132 and 134 and may be coupled to the second section 140 at areas 142 and 144. The coupling of the first section 130 to the fitting 150 and the coupling of the fitting 150 to the second section 140 may be by bonding and/or bolting techniques. Other methods of coupling are also within the scope of the present invention.

As explicitly shown in FIG. 6, the fitting 150 may include an inner section 155 provided within a width of the boom so as to receive a positioning mechanism 120 within the inner section 155. That is, the positioning mechanism 120 is provided within the inner section 155 and extends to an area above the boom. This allows movement of the main reflector 100 relative to the second antenna boom section 88. The positioning mechanism 120 may be coupled to the fitting 150 at areas 122 and 124 and may be coupled to the main reflector 100 at areas 126 and 128. The coupling of the positioning mechanism 120 to the fitting 150 and to the main reflector 100 may be by bonding and/or bolting techniques, for example. The positioning mechanism 120 may be altered by control signals that pass along signal lines (not shown in FIG. 6) in the antenna boom. The positioning mechanism 120 may thereby adjust the position of the main reflector 100. This thereby allows adjustments of the main reflector 100 either when the satellite is initially placed in orbit or at subsequent times during its operation.

The positioning mechanism 120 may be a wobble plate, a compact small angled positioner (CSAP), a biaxial gimbal, or any other well-known type of positioning mechanisms.

Accordingly, embodiments of the present invention provide an antenna system for a satellite. The antenna system may include a main reflector (such as the main reflector 100), a subreflector (such as the subreflector 110), an antenna boom and a positioning mechanism (such as the positioning mechanism 120). The antenna boom may include at least a first boom component (such as the second antenna boom section 88) to support the main reflector and a second boom component (such as the third antenna boom section 86) to support the subreflector. The first boom component may include a first main support (such as the first section 130), a fitting (such as the fitting 150) and a second main support (such as the second section 140). The fitting may couple the first main support to the second main support. The positioning mechanism may be provided within the fitting to support the main reflector. The positioning mechanism may be capable of adjusting a position of the main reflector.

Embodiments of the present invention may thereby provide a mechanism to adjust in-orbit pointing via an antenna positioning mechanism that reorients the main reflector in a sidefed offset cassegrain antenna. An antenna boom may be provided that allows an antenna tilting device to fit into the boom when the antenna is not being utilized such as during satellite launch or redeployment to another orbiting location.

Any reference in the above description to "one embodiment", "an embodiment", "example embodiment", etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the knowledge of one skilled in the art to effect such feature, structure, or characteristic in connection with other ones of the embodiments.

Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. An antenna system for a satellite comprising:

a main reflector;

a subreflector;

a boom comprising a first boom component to support said main reflector and a second boom component to support said subreflector, said first boom component including a first main support, a fitting, and a second main support, said fitting to couple said first main support and said second main support; and a positioning mechanism provided within said fitting to support said main reflector, said positioning mechanism capable of adjusting a position of said main reflector.

2. The antenna system of claim 1, wherein said positioning mechanism comprises a wobble plate.

3. The antenna system of claim 1, wherein said positioning mechanism comprises a compact small angle positioner.

4. The antenna system of claim 1, wherein said positioning mechanism comprises a biaxial gimbal.

5. The antenna system of claim 1, wherein said first main support comprises a graphite support, and said second main support comprises a graphite support.

6. The antenna system of claim 5, wherein said fitting is a metal fitting.

7. The antenna system of claim 6, wherein said fitting is bonded to said first graphite support and is bonded to said second graphite support.

8. The antenna system of claim 6, wherein said fitting is bolted to said first graphite support and is bolted to said second graphite support.

9. The antenna system of claim 1, wherein said positioning mechanism is bolted to said fitting.

10. An antenna system comprising:

an antenna boom having a first boom part, a second boom part and a third boom part; and a mechanism to support and adjust a position of a reflector, said mechanism coupled to a location within an inner area of said second boom part.

11. The antenna system of claim 10, wherein said first boom part and said second boom part define a lane, said inner area provided on one side of said plane, said mechanism to extend from within said inner area of said second boom part to another side of said plane.

12. The antenna system of claim 11, wherein said mechanism is coupled to said reflector on said another side of said plane.

13. The antenna system of claim 10, wherein said mechanism comprises a wobble plate.

14. The antenna system of claim 10, wherein said mechanism comprises a compact small angle positioner.

15. The antenna system of claim 10, wherein said mechanism comprises a biaxial gimbal.

16. The antenna system of claim 10, wherein said first boom part comprises a first graphite support, and said third boom part comprises a second graphite support.

17. The antenna system of claim 16, wherein said second boom part comprises a metal fitting.

18. The antenna system of claim 17, wherein said fitting is bonded to said first graphite support and is bonded to said second graphite support.

19. The antenna system of claim 17, wherein said fitting is bolted to said first graphite support and is bolted to said second graphite support.

20. The antenna system of claim 10, wherein said mechanism is bolted to said second boom part.

21. An antenna system comprising:

an antenna boom including a fitting coupling two adjacent sections of said boom; and a positioning mechanism coupled within an inside area of said fitting and extending above said fitting.

22. The antenna system of claim 21, further comprising a reflector, wherein said positioning mechanism couples to said reflector and adjusts a position of said reflector.

23. The antenna system of claim 21, wherein said positioning mechanism comprises a wobble plate.

24. The antenna system of claim 21, wherein said positioning mechanism comprises a compact small angle positioner.

25. The antenna system of claim 21, wherein said positioning mechanism comprises a biaxial gimbal.

26. The antenna system of claim 21, wherein said two adjacent sections comprise a first graphite support and a second graphite support.

27. The antenna system of claim 26, wherein said fitting is a metal fitting.

28. The antenna system of claim 27, wherein said fitting is bonded to said first graphite support and is bonded to said second graphite support.

29. The antenna system of claim 27, wherein said fitting is bolted to said first graphite support and is bolted to said second graphite support.

30. The antenna system of claim 21, wherein said positioning mechanism is bolted to said fitting.

* * * * *